US005379469A

United States Patent [19]

Millis et al.

[11] Patent Number: 5,379,469

[45] Date of Patent: Jan. 10, 1995

[54] INFANT CRIB

[76] Inventors: Sandra S. Millis; J. Michael Millis, both of 12 Acacia Tree La., Irvine, Calif. 92715

[21] Appl. No.: 126,874

[22] Filed: Sep. 27, 1993

[51] Int. Cl.[6] ..... A47D 7/04

[52] U.S. Cl. ..... 5/95; 5/99.1; 297/188.01; 297/7

[58] Field of Search ..... 5/93.1, 95, 99.1, 926; 297/7, 8, 9, 188

[56] References Cited

U.S. PATENT DOCUMENTS

| | | | |
|---|---|---|---|
| 111,365 | 1/1871 | McArthur . | |
| D. 174,004 | 2/1955 | Schiffman . | |
| 620,069 | 2/1899 | Cobb | 5/95 |
| 814,538 | 3/1906 | Grigsby | 5/95 |
| 838,591 | 12/1906 | Smith | 5/95 |
| 2,504,028 | 4/1950 | Lieff | 5/95 |
| 2,544,428 | 3/1951 | Judy . | |
| 2,646,576 | 7/1953 | Abrams | 5/95 |
| 2,649,594 | 8/1957 | Herz et al. | 297/5 X |
| 4,813,751 | 3/1989 | Fenn | 297/189 X |
| 5,103,514 | 4/1992 | Leach | 5/417 |
| 5,165,130 | 11/1992 | Wendling | 5/655 |
| 5,233,710 | 8/1993 | Bernard | 5/99.1 X |

*Primary Examiner*—Michael F. Trettel
*Attorney, Agent, or Firm*—Jack C. Munro

[57] ABSTRACT

An infant crib in the form of a front panel to which is pivotally connected at each end thereof a side panel. The side panels are of a substantially greater height than the front panel. Each side panel is to be wedged along the side of a seat cushion of a couch or chair until the front panel is located directly adjacent the front edge of the cushion thereby forming an enclosed area to confine an infant when located on the top surface of the cushion.

20 Claims, 2 Drawing Sheets

INFANT CRIB

BACKGROUND OF THE INVENTION

1. Field of the Invention

The field of this invention relates to cribs and more particularly to a crib that is to be formed in conjunction with a conventional couch or chair which includes a padded sitting cushion.

2. Description of the Prior Art

Infants have a tendency to roll around when placed in a lying position. Parents have a tendency to place infants when left unoccupied even for a few moments on the most convenient soft lying area available. This frequently is on a padded cushion of a couch or chair. It only takes one quick roll of the infant and the infant rolls right off the couch or chair. Most of the time the infant is not hurt, but merely begins to cry. However, in a small number of cases, the infant falls in just the right position and becomes injured. There is the exceedingly rare possibility that the infant can actually become injured sufficiently as to cause death.

Within the prior art there have been numerous attempts at designing different types of cribs with even some cribs being constructed to be used in conjunction with a couch or chair. However, these cribs have not been of simple construction and frequently included hard members such as wooden rails which also could cause injury to the infant.

It also has been known to construct a mat with the edges of the mat being enlarged forming a ridge of resilient foam material. Such mats work well on a floor of a house but normally do not work well in conjunction with a couch or chair. This requires the user to have to bend over all the way to the floor in order to pick up the infant and also put down the infant. If the user did not need to have to bend over that far and only needed to place the infant on a couch or chair, it would be a lot easier on the user's body especially after repeated picking up and replacing of the infant.

SUMMARY OF THE INVENTION

An infant crib constructed of a front planer rigid panel, a right side planer rigid panel and a left side planer rigid panel. The right side planer rigid panel is to be movably connected to the right edge of the front panel with there being a pivot joint located therebetween. The same is true for the left side rigid panel and the left side edge of the front panel. All three panels are capable of assuming a collapsed position with the three panels in juxtaposition. The three panels are also locatable with the right side and left side panels being located substantially perpendicularly transverse to the front panel. The side panels are about twice the height of the front panel with the front panel being secured to their side panels so the top edges of the side panels align with the top edge of the front panel. The lower portion of the side panels is to be wedged in conjunction with a cushion of a couch or a chair with each side panel being located along a side edge of the cushion forming a secure connection between the couch or chair and the panels. The panels thereby define an enclosing area which is to confine an infant that would be placed on the cushion. The panels can be adjustable in length and the panels may include appropriate flaps to extend under the cushion to provide a further securement of the crib to the cushion. The panels are to be covered with a resilient (soft) material.

The primary objective of the present invention is to construct an infant crib that can be quickly and easily connected to a couch or cushion and form a confined area for the infant to prevent the infant from rolling off of the couch or chair.

Another objective of the present invention is to construct an infant crib that can be constructed of few parts, manufactured inexpensively and thereby sold to the ultimate consumer at an inexpensive price.

A further objective of the present invention is to construct an infant crib which can be readily adjusted to accommodate to different sizes of couches and different sizes of chairs.

Another objective of the present invention is to construct an infant crib which can be readily cleaned upon the crib becoming soiled.

Another objective of the present invention is to permit the crib to be stored in a small area when not being used thereby facilitating portability.

DETAILED DESCRIPTION OF THE SHOWN EMBODIMENT

Figure 1:
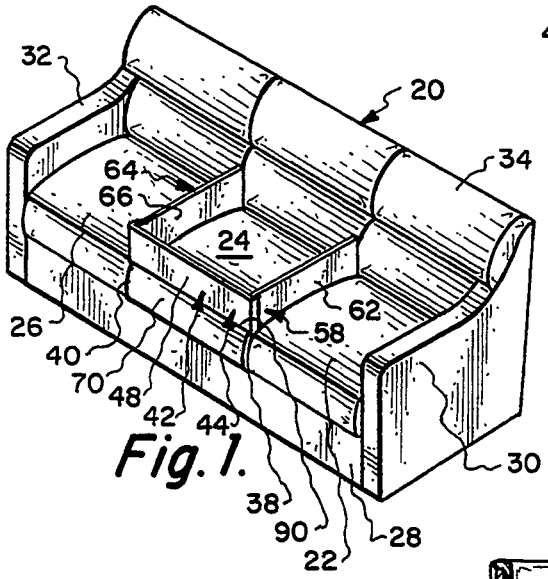
FIG. 1 is an isometric view showing usage of the infant crib of the present invention in conjunction with the conventional couch.
Figure 4:
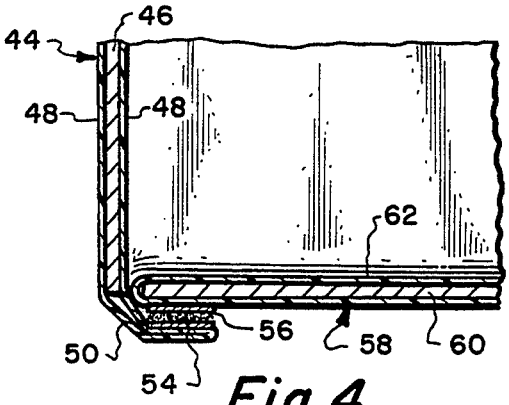
FIG. 4 is a cross-sectional view taken along line 4—4.
Figure 3:
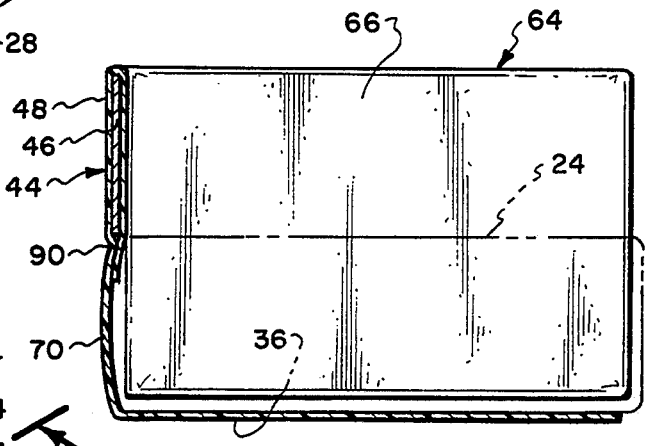
FIG. 3 is a cross-sectional view taken along line 3—3 of FIG. 2.

Referring particularly to the drawings there is shown a couch 20 which has a base 28 to which is attached a back section 34. The sides of the couch 20 terminate at side arms 30 and 32. Resting on the base 28 are a plurality of cushions 22, 24 and 26. The cushions 22, 24 and 26 are all the same size, which is normal. However, the cushions 22, 24 and 26 could vary in size or could be of a different size other than the rectangular shape that is shown. The infant crib 42 of this invention is designed to be utilized in conjunction with any shape of cushion.

Between cushions 22 and 24 is abutting side wall area 38 and between cushion 24 and 26 is abutting side wall area 40. The infant crib 42 is formed of a right side wall panel 58 and left side wall panel 64. The lower portion of the right side wall panel 58 is to be wedgingly inserted in a snug fitting manner within the side wall area 38. The lower portion of the side wall 64 is to be wedgingly inserted in a snug relationship within the side wall area 40. The cushion 24 has a bottom 36 which is to be located against the base 28 with the cushion 24 located within the cushion receiving chamber of the couch 20.

The side panels 58 and 64 are located in a parallel spaced apart relationship with a front panel 44 located there between. The front panel 44 includes a central rigid member 46 which can comprise either wood, plastic or other similar type of material. Covering the rigid member 46 is a fabric or plastic covering 48. At the right end of the panel 44 there is located a flexible connecting strip 50 which is to function as a pivot joint. At the opposite end of the panel 44 is located a similar connecting strip 52. The connecting strip 50 has fixedly mounted thereon a fastener pad 54. The fastener pad 54 is to comprise either a mass of tiny hooks or tiny eyelets with a pad 56 comprising the opposite of pad 54. Pad 56 is fixedly mounted on the covering 62 of the right side panel 58. The right side panel 58 includes a interior rigid member 60 similar to member 46. The covering of 48 and 62 should be a soft plastic which facilitates cleaning when soiled.

Figures 6, 7, 8, 9, 10, 11:
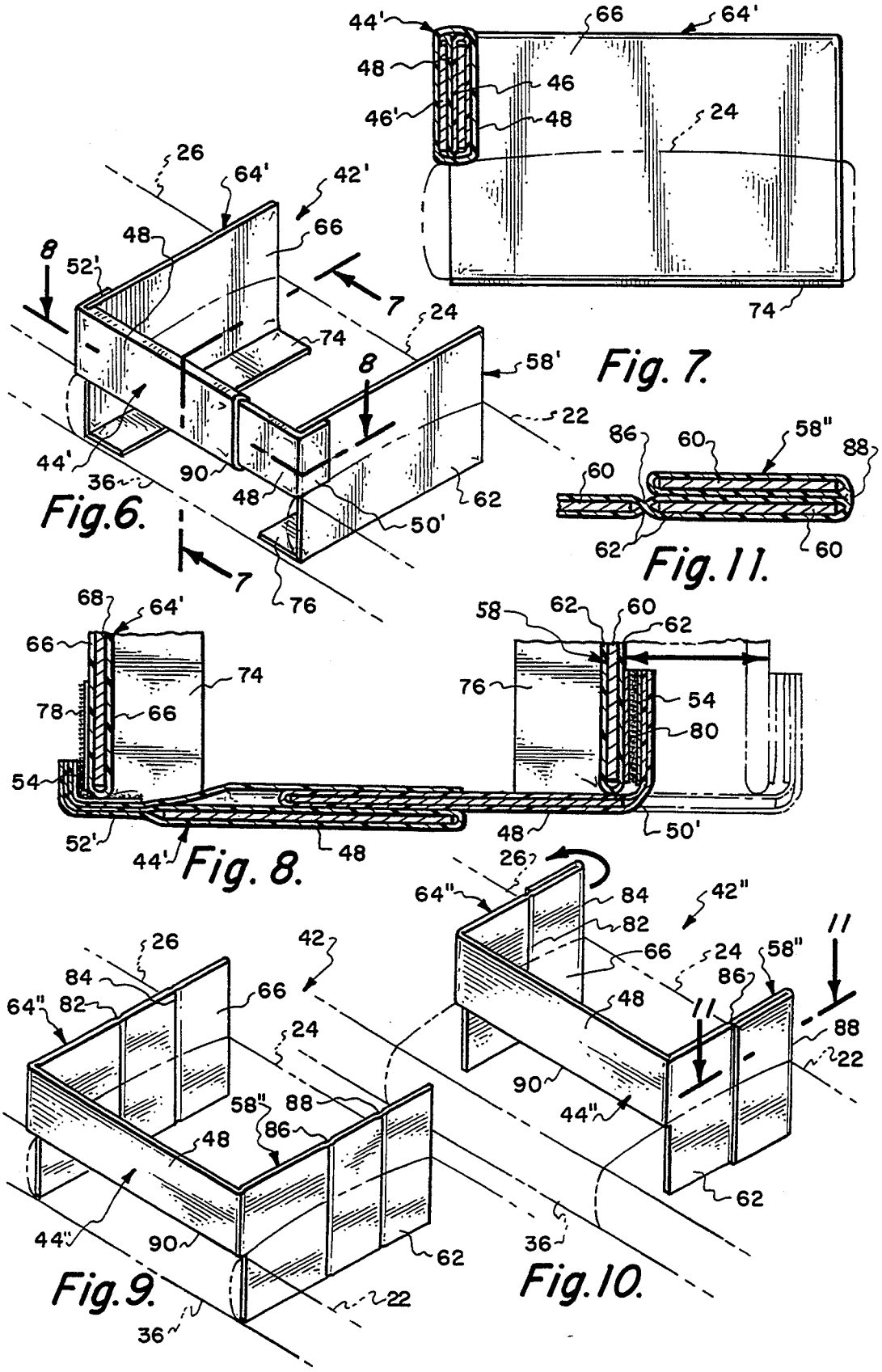
FIG. 6 is an isometric view of the infant crib of the present invention similar to FIG. 2 but of a modified form of the infant crib.
FIG. 7 is a cross-sectional view taken along line 7—7 of FIG. 6.
FIG. 8 is a cross-sectional view taken along line 8—8 of FIG. 6.
FIG. 9 is a isometric view similar to FIG. 6 but of a further modified form of the infant crib.
FIG. 10 is a isometric view showing the infant crib of FIG. 9 in a different position.
FIG. 11 is a cross-sectional view taken along line 11—11 of FIG. 10.

The fastener pads 54 and 56 function to permit disengagement of the right side panel 58 from the front panel 44. It is considered to be within the scope of this invention to construct the infant crib 42 so that the connecting strip 50 would be integral between the covering 48 and the covering 62 which is shown in FIGS. 10 and 11. However, by having side panel 58 disengage from the front panel 44, cleaning of the infant crib 42 is facilitated.

It is to be understood that the connecting strip 52 has a pad similar to pad 54 with there being also a pad similar to pad 56 mounted on the left side panel 64. The left side panel 64 is covered by a covering 66 which is essentially identical to covering 62. The left side panel 64 also includes an interior rigid member 68.

Figure 2:
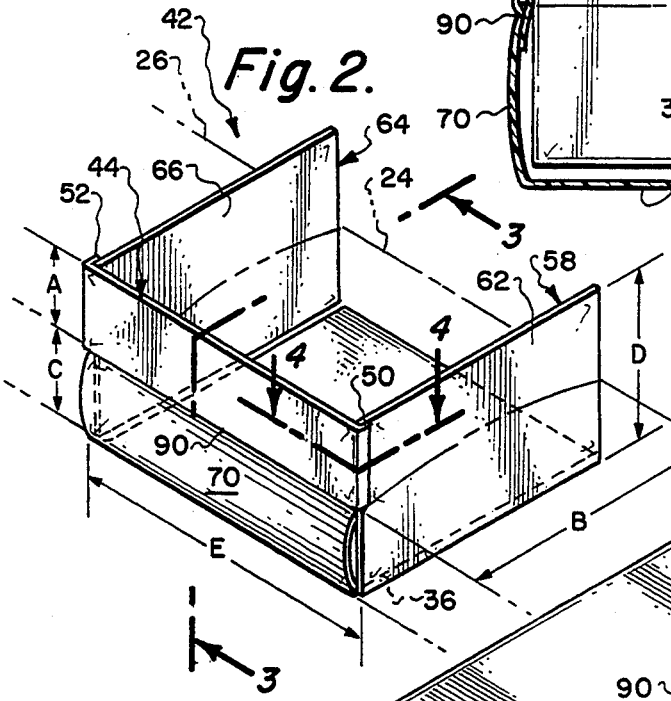
FIG. 2 is an isometric view of just the infant crib with the cushions of the couch being depicted in phantom lines.

It is to be noted that the height of both the right side panel 58 and the left side panel 64 is identical with this height being shown by D in FIG. 2. The height of the front panel 44 is represented by A in FIG. 2 with this height generally being about one-half of D. At the lower edge 90 of the front panel 44 there is fixedly secured a front fabric flap 70. This front fabric flap 70 is deemed to be optional and is not shown within FIGS. 6 to 11 of the drawings. The purpose of the front fabric flap 70 is to be located against the bottom 36 and the base 28 of the cushion 24 and to be snugly retained therebetween. The purpose of the front fabric flap 70 is to prevent any infant, when placed on the cushion 24, from pushing outward on the front panel 44 sufficiently to permit the infant to slip through the opening that is created between the front panel 44 and the seat cushion 24 with the infant falling to the floor on which the couch 20 is located. The portion of the front fabric flap 70 that covers the front surface of the cushion 24 has a height of C with it being understood that A plus C equals D. The width of the front fabric flap 70 is represented as E with it being understood that this width is substantially equal to the width of the front panel 44.

Referring again to FIG. 1 it can be seen that the infant crib 42 of this invention, when located in conjunction with the couch 20, forms an enclosing area. It is within this enclosing area that the infant is to be located with the infant resting directly on the cushion 24. In order to catch any possible spitting by the infant, there will normally be located a blanket on the cushion 24 to avoid staining of the cushion 24.

Referring particularly to FIGS. 6, 7 and 8 of the drawings, there is shown a modified form of infant crib 42 of this invention. Within this modified form 42′ there is located a right side panel 58′ and left side panel 64′ which are basically identical, respectively, to the right side panel 58 and left side panel 64. Also similar numbers have been utilized within the modified form 42′ to refer to similar parts when compared with the infant crib 42.

One distinction within FIGS. 6, 7 and 8 is that the right side panel 58′ has attached at the lower end thereof a bottom panel 76. A similar bottom panel 74 is attached to the bottom edge of the left side panel 64′. These bottom panels 74 and 76 are constructed of the same materials as the panels 58′ and 64′ with the panel 76 being pivotable relative to the bottom edge of panel 58′ and the panel 74 being pivotable relative to the bottom edge of the panel 64′. The purpose of the panels 74 and 76 are to be located against the bottom 36 of the cushion and rest on the base of 28 to provide an additional securement of the infant crib 42′ in conjunction with the couch 20 if such additional securement is deemed to be desired. The pivoting connection between the panels 76 and 74 relative to their respective side panels 58′ and 64′ is established merely by their respective coverings 62 and 66 with there not being any rigid member in the area of the pivot joint.

The modified form 42′ also includes a different version of front panel 44′. The front panel 44′ is constructed of two different sections which are joined together in an interconnected sliding relationship. Although most cushions, such as cushions 22, 24 and 26, are constructed to be about the same size, some cushions are wider than others. In such an instance it may be desired to incorporate a size expanding feature in conjunction with the infant crib with this lateral adjustment being achieved by the sliding interconnection of the front panel 44′. Further additional adjustment may be achieved by making the connecting strips 50′ and 52′ longer than their respective connecting strips 50 and 52. The additional length of these connecting strips 50′ and 52′ could be utilized instead of the different version front panel 44′. To further increase the adjustability provided by the connecting strips 50′ and 52′, their respective pads 80 and 78, to which the fastener pads are to connect, are also longer in length than their respective pads 56. The pad 80 is fixedly mounted on the right side panel 58′ with the pad 78 being fixedly mounted on the modified form of right side panel 64′. The second member of the sliding interconnection front panel 44′ includes a rigid member 46′.

Referring in particular to FIGS. 9–11 of the drawings, there is shown a further modified form 42″ of the infant crib of this invention. The modified form 42″ includes a front panel 44″ which is again covered with covering 48 which is integral with the covering on the side panels 58″ and 64″. The only real difference in the crib shown in FIGS. 9 to 11 is that the side panel 58″ and 64″ each include a pair of vertical pivot joints represented as pivot joints 82 and 84 for side panels 64″ and pivot joints 86 and 88 for side panel 58″. The pivot joints 82 and 84 permit the side panel 64″ to be folded over upon itself to decrease the length B of the side panel 64″. The same is true relative for the side panel 58″. The only reason that it would be desired to decrease the length B would be if the infant crib 42″ is placed on a couch 20 that has cushions that have a less than normal depth or possibly the user wants to install the crib 42" so that the front panel 44" is spaced rearwardly from the front edge of the cushion 24 on which it is mounted.

Figure 5:
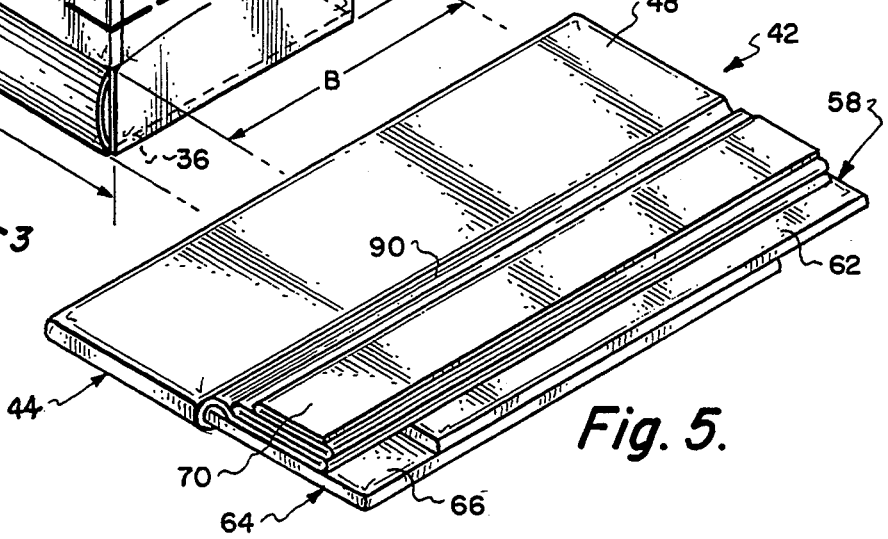
FIG. 5 is an isometric view showing the infant crib in the collapsed position.

Referring particularly to FIG. 5 there is shown the collapsed position of the infant crib 42. This collapsed is obtained by the right side panel 62 being pivoted about ninety degrees in juxtaposition to the front panel 44 with left side panel then being pivoted ninety degrees against the right side panel 58. The front fabric flap 70 is merely folded into a series of layers. This collapsed position, shown in FIG. 5, facilitates storage and portability of the infant crib 42. The modified versions 42" and 42" are also to assume the similar collapsed position.

What is claimed is:

1. An infant crib adapted to be placed in conjunction with a piece of furniture used to locate one or more infants in a sitting position where the furniture has at least one sitting cushion, said crib comprising:

a front panel terminating at a pair of ends, a right side panel attached at a pivot point to one of said ends, a left side panel attached at a pivot point to the other of said ends, both said right side panel and said left side panel being movable by their respective pivot joints at least ninety degrees relative to said front panel between an extended position and a collapsed position, said collapsed position being when said front panel and said left side and right side panels are located in juxtaposition, said extended position being when said side panels assume a transverse position relative to said front panel, said side panels having substantially a greater height than said front panel, said front panel and said right and left panels being rigid, whereby with said side panels in said extended position a portion of each said side panel is to wedgingly engage between the sitting cushion and the remainder of the piece of furniture.

2. The infant crib as defined in claim 1 wherein:

said front panel being planer, said right side panel being planer, said left side panel being planer.

3. The infant crib as defined in claim 1 wherein:

said side panels being of the same height, the height of said side panels being approximately twice as great as the height of said front panel.

4. The infant crib as defined in claim 1 wherein:

said side panels being of the same length.

5. The infant crib as defined in claim 1 wherein:

each said pivot joint including a releasable and reengagable fastener, each said fastener permitting disengagement of its respective said side panel from said front panel.

6. The infant crib as defined in claim 5 wherein:

each said fastener being adjustable so as to vary the position of each said side panel relative to said front panel.

7. The infant crib as defined in claim 6 wherein:

said pivot joints comprising at least one layer of sheet material.

8. The infant crib as defined in claim 1 wherein:

a front sheet material flap being attached to said front panel and located between said side panels when in said extended position, whereby said front sheet material flap being locatable under the sitting cushion.

9. The infant crib as defined in claim 1 wherein:

each said side panel including a bottom panel, each said bottom panel being pivotally mounted relative to its respective said side panel, each said bottom panel adapted to be located beneath the sitting cushion.

10. The infant crib as defined in claim 1 wherein:

said front panel being adjustable in length.

11. The infant crib as defined in claim 1 wherein:

each said side panel being adjustable in length.

12. In combination with a piece of furniture adapted for humans to be located in a sitting position, said piece of furniture having a base on which is located a cushion receiving chamber, said cushion receiving chamber having side arms, a cushion located in a snug relationship between said side arms and within said cushion receiving chamber, said cushion having sides with each said side being located directly against a said side arm, said cushion having a bottom which rests on said base, said cushion having a front edge located at the entrance to said cushion receiving chamber, an infant crib comprising:

a front panel terminating at a pair of ends, a right side panel, a left side panel, a first fastener interconnecting said front panel and said right side panel, a second fastener interconnecting said front panel and said left side panel, said first fastener including a first pivot joint permitting movement of said right side panel from a collapsed position in juxtaposition with said front panel to an extended position located substantially transverse to said front panel, said second fastener including a second pivot joint permitting movement of said left side panel from a collapsed position in juxtaposition with said front panel to an extended position located substantially transverse to said front panel, said front panel and said right side panel and said left side panel being rigid, said right side panel when in said extended position to be wedged between a side of said cushion and a said side arm and said left side panel when in said extended position to be wedged between a said side of said cushion and the remaining said side arm with said front panel being located directly adjacent said front edge of said cushion, whereby said crib is secured in position on said piece of furniture.

13. The combination as defined in claim 12 wherein:

said front panel being planer, said right side panel being planer, said left side panel being planer.

14. The combination as defined in claim 12 wherein:

said first fastener being adjustable so as to vary the spacing between said right side panel and said front panel, said second fastener being adjustable so as to vary the spacing between said left side panel and said front panel.

15. The combination as defined in claim 14 wherein:

both said first fastener and said second fastener comprising interconnecting male and female strips of tiny hooks and eyelets, said first fastener also including a section of fabric with said second fastener further including a section of fabric, said sections of fabric permitting pivoting of said right side and said left side panels relative to said front panel.

16. The combination as defined in claim 12 wherein:

said right side panel being substantially the same height as said left side panel, the height of said right side panel and said left side panel being substantially twice as great as the height of said front panel.

17. The combination as defined in claim 12 wherein:

said front panel including a front fabric flap, said front fabric flap to be located against said bottom of said cushion and against said base.

18. The combination as defined in claim 12 wherein: said right side panel including a bottom panel, said left side panel having a bottom panel, said bottom panels being pivotally mounted to their respective said side panel, said bottom panels to be located against said bottom of said cushion and resting on said base.

19. The combination as defined in claim 12 wherein: said front panel being adjustable in length.

20. The combination as defined in claim 12 wherein: each said side panels being adjustable in length.

* * * * *